United States Patent [19]

Lolley

[11] 4,403,458

[45] Sep. 13, 1983

[54] CONJOINT FACIA

[75] Inventor: Ted E. Lolley, Tucker, Ga.

[73] Assignee: MM Systems Corporation, Tucker, Ga.

[21] Appl. No.: 289,087

[22] Filed: Jul. 31, 1981

[51] Int. Cl.[3] ..... E04D 13/15

[52] U.S. Cl. ..... 52/60; 52/96

[58] Field of Search ..... 52/94, 95, 96, 58, 60

[56] References Cited

U.S. PATENT DOCUMENTS

| | | | |
|---|---|---|---|
| 3,680,269 | 8/1972 | Fischer | 52/94 |
| 3,735,540 | 5/1973 | Thaler | 52/94 |
| 3,766,694 | 10/1973 | Minialoff | 52/95 |
| 3,862,531 | 1/1975 | Attaway | 52/58 |
| 4,037,372 | 7/1977 | Patry | 52/96 |
| 4,071,987 | 2/1978 | Hickman | 52/94 |
| 4,241,549 | 12/1980 | Hall et al. | 52/60 |

*Primary Examiner*—John E. Murtagh
*Assistant Examiner*—Kathryn L. Ford
*Attorney, Agent, or Firm*—John B. Armentrout

[57] ABSTRACT

A conjoint facia, hood and water dam is provided having dam and first engagable means affording dam means and first engagable means. Ridge structure of the dam means, against which ridge structure sheet roofing rests, is covered by hood structure of at least one facia and hood member, with there being second engagable means of the conjoint facia, hood and water dam available as an extension of the facia and hood member. The first and second engagable means together form tongue means and grooved means for these means to be engaged and the first engagable means includes detaining means for upward movement of the facia and hood member relatively to the dam and first engagable means to be stopped. The tongue means and the grooved means are aligned to be engaged after downwardly moving the facia and hood member relatively to the dam and first engagable means against bias of biasing means disposed inside the hood structure of the facia and hood member between the hood structure and the sheet roofing on the ridge structure of the dam means, meanwhile having the hood structure cover the ridge structure. The tongue means and the grooved means are engaged by then upwardly moving the facia and hood member relatively to the dam and first engagable means by reactive thrust of the biasing means, having the tongue means and the grooved means relatively move engaged until the upward movement of the facia and hood member relatively to the dam and first engagable means is stopped by the detaining means, thereafter to have the tongue means and the grooved means still engaged, the facia and hood member still covering the ridge structure, and the biasing means still pressing the sheet roofing against the ridge structure and reactively biasing the facia and hood member to move upwardly.

16 Claims, 12 Drawing Figures

Fig. 10
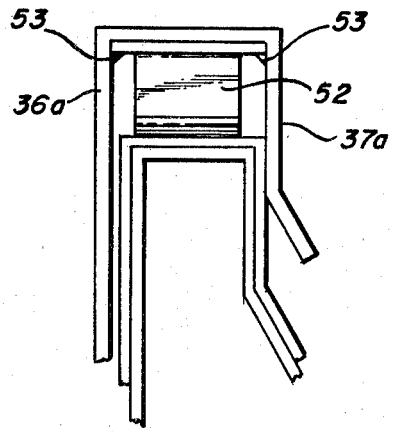
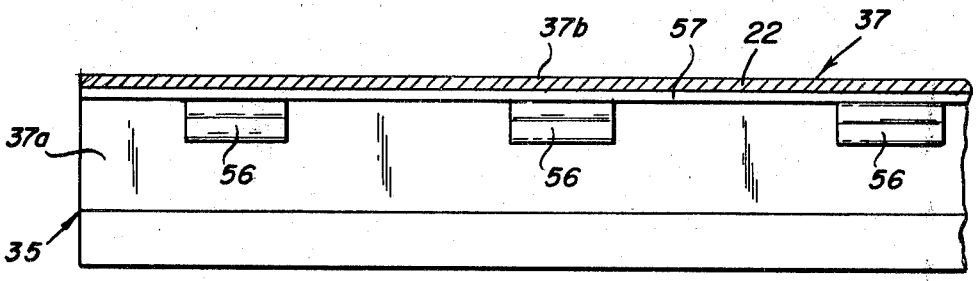
Fig. 11
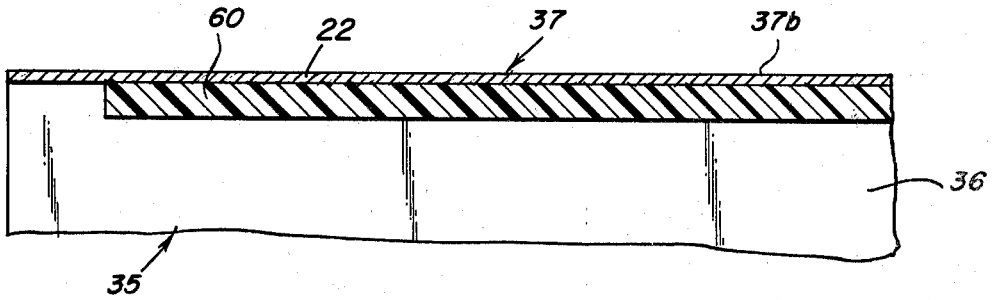
Fig. 12

CONJOINT FACIA

The present invention relates to buildings and their appurtenances, and is more particularly concerned with facia and water dam means used as an adjunct to a roof deck and an outside wall structure of a building.

An object of this invention is to lend improvements in facia and water dam structure which is to be used as an adjunct to a roof deck and an outside wall of a building.

Another object of the present invention is to provide a conjoint facia, hood and water dam wherein one or more facia and hood members serving as trim when installed, through use of first and second engagable means, are adapted to conceal biasing means interposed between hood structure of the facia and hood member and ridge structure of the dam means.

Another object herein is the provision of a conjoint facia, hood and water dam of the character indicated wherein the biasing means is interposed between the facia and hood member and the ridge structure, contacts sheet roofing on the ridge structure, and clamps the sheet roofing against the ridge structure while biasing the facia and hood member to remain in place in the conjoint facia, hood and water dam as installed.

A further object herein is that of providing a conjoint facia, hood and water dam of the character indicated wherein the first and second engagable means provide tongue means and grooved means which are adapted to be engaged following downward movement of the facia and hood member against bias of the biasing means, with the latter interposed in contact with the sheet roofing on the ridge structure and against the hood structure of the facia and hood member interiorly of the hood structure, and which tongue means and grooved means are engaged upon upward movement of the facia and hood member under bias of the biasing means and produce interlock in the conjoint facia, hood and water dam as installed.

Other objects of the present invention in part will be obvious and in part pointed out more fully hereinafter.

As conductive to a clearer understanding of certain features of the present invention, the provision of a water dam on a roof deck, which incidentally usually is recognized as being a substantially flat horizontal roof, or a roof having a relatively low rake, is favored in the architectural field, thus to control against spill-off of water at the edge of the roof deck and thence downward along an outside wall of the building. A water dam in serving the latter purpose may also be a barrier for other materials such as gravel on the roof deck.

Numerous problems heretofore have been confronted as being needful of solution on how to cover sheet roofing with trim which requires securement after the sheet roofing has been extended onto the dam from the roof deck, and accordingly a further object of the present invention is to provide conjoint facia, hood and water dam means which lends improvements having to do with holding the sheet roofing against the dam and attaching trim afforded by the conjoint facia, hood and water dam means.

In accordance with the present invention, a conjoint facia, hood and water dam is provided for use appurtenant to a building and is characterized by including dam and first engagable means wherein dam means having longitudinal ridge structure with upwardly extending laterally opposite forward and rearward sides is adapted to face forwardly outwardly on a roof deck of the building, while being adjacent to an outside wall of the building, to support sheet roofing extended from the roof deck onto the ridge structure. First engagable means of the dam and first engagable means, as installed, occupies a position below the ridge structure of the dam means, and the ridge structure of the dam means is supported to stay in a substantially fixed position above the roof deck. Facia and hood means, also provided in the conjoint facia, hood and water dam, comprises at least one facia and hood member wherein facia means is provided to be disposed frontally of the dam means and the related wall of the building, and the facia and hood member further includes hood structure for covering the sheet roofing on the ridge structure of the dam means. In the covering relation just noted, downwardly extending laterally opposite forward and rearward walls of the hood structure are disposed laterally outside the upwardly extending forward and rearward sides of the ridge structure of the dam means, having the sheet roofing extend between the ridge structure and the hood structure.

The conjoint facia, hood and water dam also includes second engagable means as a lower extension of the facia means of the facia and hood member, and the first and second engagable means together form tongue means and grooved means for the tongue means and the grooved means to be engaged. The first engagable means also comprises detaining means for stopping upward movement of the facia and hood member relatively to the dam and first engagable means while the grooved means and the tongue means are engaged.

With the dam and first engagable means already installed, the tongue means and the grooved means interlock laterally of the lead of the tongue means into the grooved means during and after installing the facia and hood member, and the direction of the lead of the tongue means into the grooved means introduces vertical reach of the tongue means to prevent horizontal lateral escape of the facia means. Resilient biasing means disposed inside the hood structure of the facia and hood member and abutted against the hood structure and against the sheet roofing on the ridge structure, is adapted to be pressed downward in resilient response to downward movement of the facia and hood member relatively to the dam and first engagable means, for the tongue means and the grooved means to be aligned for engagement, the downward movement being with having the downwardly extending laterally opposite forward and rearward walls of the hood structure in the facia and hood member laterally outside the upwardly extending laterally opposite forward and rearward sides of the ridge structure. The compressed biasing means thereafter reactively causes the facia and hood member to move bodily upward relatively to the dam and first engagable means, having the tongue and grooved means engaged, and the upward movement of the facia and hood member is eventually stopped by the detaining means, still having the tongue means and the grooved means engaged and the biasing means still clamping the sheet roofing against the ridge structure and reactively urging the facia and hood member in an upward direction, this with the hood structure still covering the sheet roofing on the ridge structure and the laterally opposite downwardly extending forward and rearward walls of the hood structure still being laterally outside the laterally opposite upwardly extending forward and rearward sides of the ridge structure.

It will be appreciated that the hood structure of the facia and hood member conceals the biasing means with allowance for the sheet roofing to extend between the hood structure and the ridge structure and between the biasing means and the ridge structure. The hood structure of the facia and hood member preferably is horizontally laterally loosely allocated by having its laterally opposite downwardly extending walls horizontally laterally loosely outside the ridge structure and the sheet roofing on the ridge structure, to facilitate the downward and upward movements of the facia and hood member, and thus for the hood structure to be horizontally laterally stabilized by the compressed biasing means during and after those movements. It is also preferred, such as under the latter circumstances, to have the hood structure of the facia and hood member constrain the facia means, during the downward movement of the facia and hood member, to press the grooved means and the tongue means laterally together slidably one against the other until snap acting one off the other into alignment for being engaged, thereby allowing the upward movement of the facia and hood member with the tongue means and the grooved means engaged to ensue under thrust of the biasing means.

In accordance with preferred embodiments of this invention, the dam means has a lower rearward inclined side merged with a lower portion of the rearward of the laterally opposite upwardly extending sides of the ridge structure, and the lower rearward inclined side of the dam means deviates from the upwardly extending side of the ridge structure by leading downwardly and rearwardly toward the roof deck to support the sheet roofing which extends thence onto the ridge structure of the dam means. A lowermost rearward portion of the facia and dam member defines a narrowing gap within limits with the sheet roofing on the lower rearward inclined side of the dam means during the downward movement of the facia and hood member, enabling the tongue means and the grooved means to be aligned for being engaged, and this same lowermost rearward portion defines a widening gap with the sheet roofing on the lower inclined rearward side of the dam means during the upward movement of the facia and hood member having the tongue means and the grooved means engaged. In the detained, biased installed condition of the facia and hood member, the lowermost rearward portion of the facia and hood member accordingly remains spaced upwardly away from the sheet roofing on the lower inclined rearward side of the dam means.

In the accompanying drawings wherein several embodiments of the present invention are represented:

Figure 9:
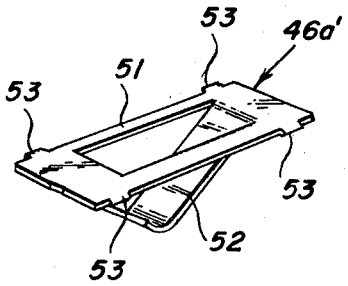

FIGS. 9 and 10 respectively represent another form of biasing unit and the biasing unit installed;

FIG. 11 represents strip and biasing means, amounting to a further modification, as used with a facia and hood member, a fragment of the latter being shown with view being toward the rear of the facia and hood member from a longitudinal cross section forwardly taken through the hood structure of that member; and FIG. 12 is a rearward to forward view, partially in longitudinal cross section, of a facia and hood member provided with a still further form of biasing means.

In the embodiment of this invention represented in FIGS. 1 to 5 of the accompanying drawings, a conjoint facia, hood and water dam 10, to be described herein with reference to a particular installation, is disposed on a roof deck 11 of a building and is adjacent to an outside wall 14 of that same building. Roof deck 11 is a substantially horizontal deck and is inclusive of a concrete slab 13 topped off by an asphaltic roofing mixture 13*a*. Securement strip means 16, of wood or of any other suitable material, has a fixed position at an edge of the roof deck 11 and thus next to the outside wall 14 of the building. The roofing mixture 13*a* has been brought flush with the top side of the securement strip means 16 and is covered at least at the border of the roof deck 11 next to the conjoint facia, hood and water dam 10 by sheet roofing 15, the latter being associated with dam means of the conjoint facia, hood and water dam 10 in a manner hereinafter more fully to be described.

A pair of dam members 17 (see FIGS. 1 and 2) similar in transverse cross section are arranged having adjacent longitudinal ends, as installed, for these members to be in longitudinal prolongation of one another; however, in certain instances only a single dam member 17 need be used or more than two such dam members are installed in longitudinal prolongation of one another as occasion may dictate. Each member 17 is characterized by having a front side 19, and a longitudinal ridge structure 20 wherein substantially upright forward and rearward laterally opposite sides 19*a* and 21 are interconnected by a top lateral end 22 of the ridge structure, with the substantially upright forward side 19*a* also being a portion of the front substantially upright side 19 of the dam member 17. The rearward substantially upright side 21 of the ridge structure 20 merges with a lower rearward inclined side 23 of the dam member 17 and the lower inclined side 23 leads downwardly and rearwardly toward the roof deck 11. Externally, at the rear, therefore, the dam member 17 is laterally reentrant, through having the lower rearward inclined side 23 deviate from the substantially upright side 21. One of the two adjacent longitudinal ends of the dam members 17 (see FIG. 3) is swaged downward at an end portion 22' of the top side 22 thereof and is swaged forward at an end portion 21' of the rearward substantially upright side 21 thereof to facilitate lapped nesting of these longitudinal end portions of the dam members.

The dam members 17 are for example fashioned from sheet material such as of galvanized steel or aluminum base alloy, and each dam member includes first engagable means integral therewith, suitably in the form of longitudinal lateral tongue means 19*b* projecting outwardly and downwardly laterally of the dam member 17 from the lower end of the front side 19 as defined by an arris 25 (see FIGS. 1 and 2) which leads longitudinally of the dam member 17. In certain embodiments in accordance with the present invention, the longitudinal lateral tongue means 19*b* is introduced by means separate from the dam means 17 and thus is separately attached to the building wall. The front side 19 of the dam member, including the substantially upright forward side 19*a* of the ridge structure 20, is a panel bordered at upper end at arris 26, while the top lateral end 22 is a bight wall portion between the arrises 26 and 27. Further, the rearward substantially upright side 21 of the ridge structure is a panel between the arrises 27 and 28, and the lower inclined side 23 is a panel bordered at the arrises 28 and 29, and is integral with connective means suitably in the form of longitudinal lateral flange means 30 resting against the roof deck 11. The arrises 26 and 27 at the top lateral end 22 of the ridge structure 20 in each dam member 17 are substantially parallel with one another and with the arrises 25, 28 and 29, extending longitudinally of the dam member 17. The outer edge of the longitudinal lateral flange means 30, and the outer edge of the tongue means 19*b* preferably co-extend substantially parallel with the arrises 25 and 29 in the dam member 17. In certain embodiments of this invention each of the dam members 17 is provided as an extrusion.

Each of the dam members 17 is maintained installed through use of fastener means; suitably, headed nails or screws 31 and 32 applied through the front side 19 and through the rear connective means 30 into the aforementioned securement strip 16 on the roof deck 11 having the front side 19 project substantially in a downward direction along the wall of the building. The sheet roofing 15 leads from the roof deck 11 onto the dam members 17 to rest upon the lower rearward inclined sides 23 and cover the ridge structures 20 while being down forwardly along the front sides 19 of the dam members 17.

Figure 1:
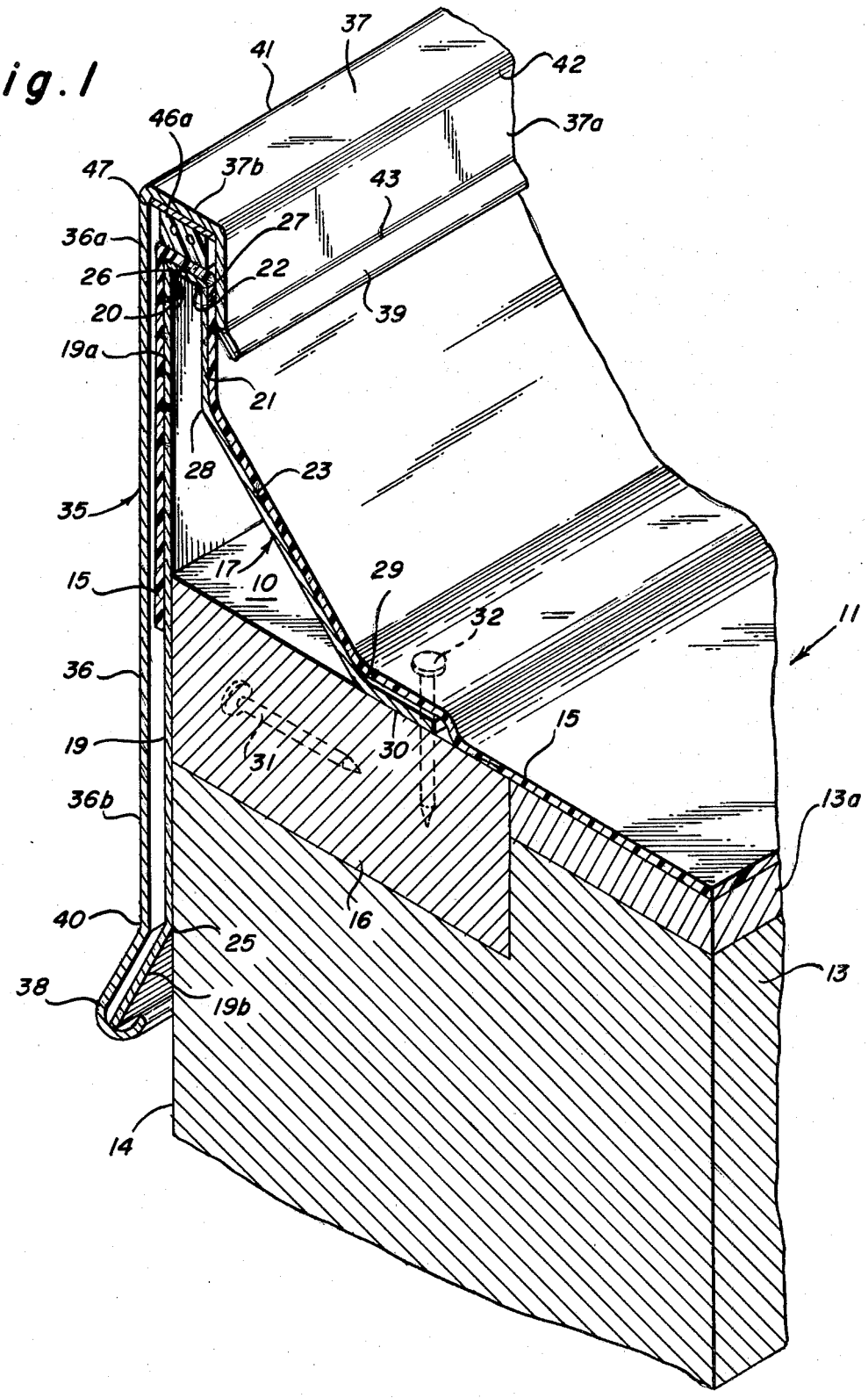
FIG. 1 is a fragmentary isometric view representing a conjoint facia, hood and water dam installed on a roof deck.
Figure 3:
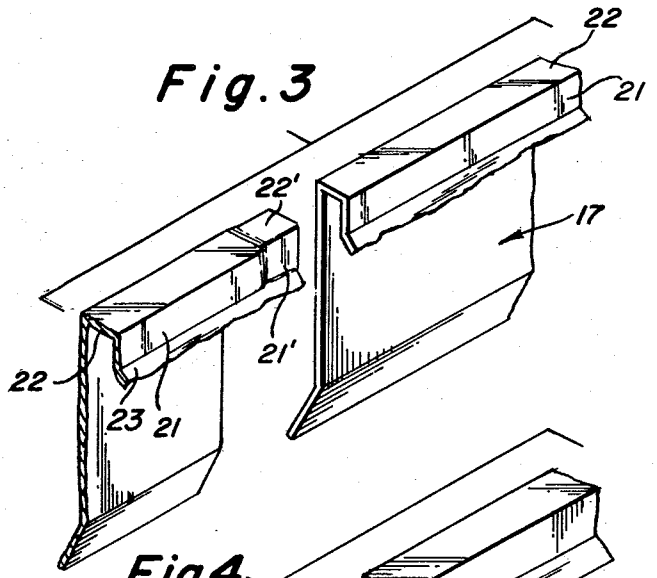
FIG. 3 is an isometric detail of a joint used at longitudinal ends of the dam members in FIG. 2.
Figure 4:
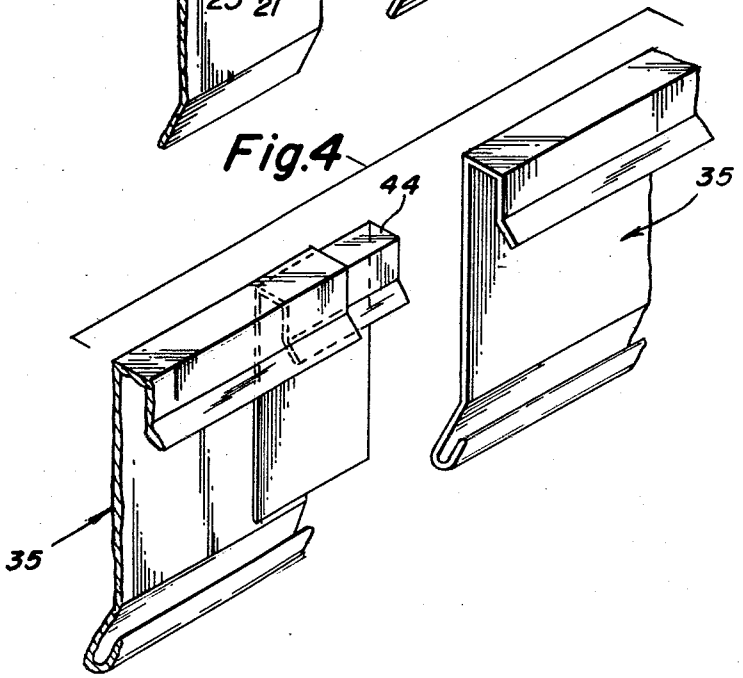
FIG. 4 is an isometric detail of a joint used at longitudinal ends of the facia and hood members in FIG. 2.
Figure 2:
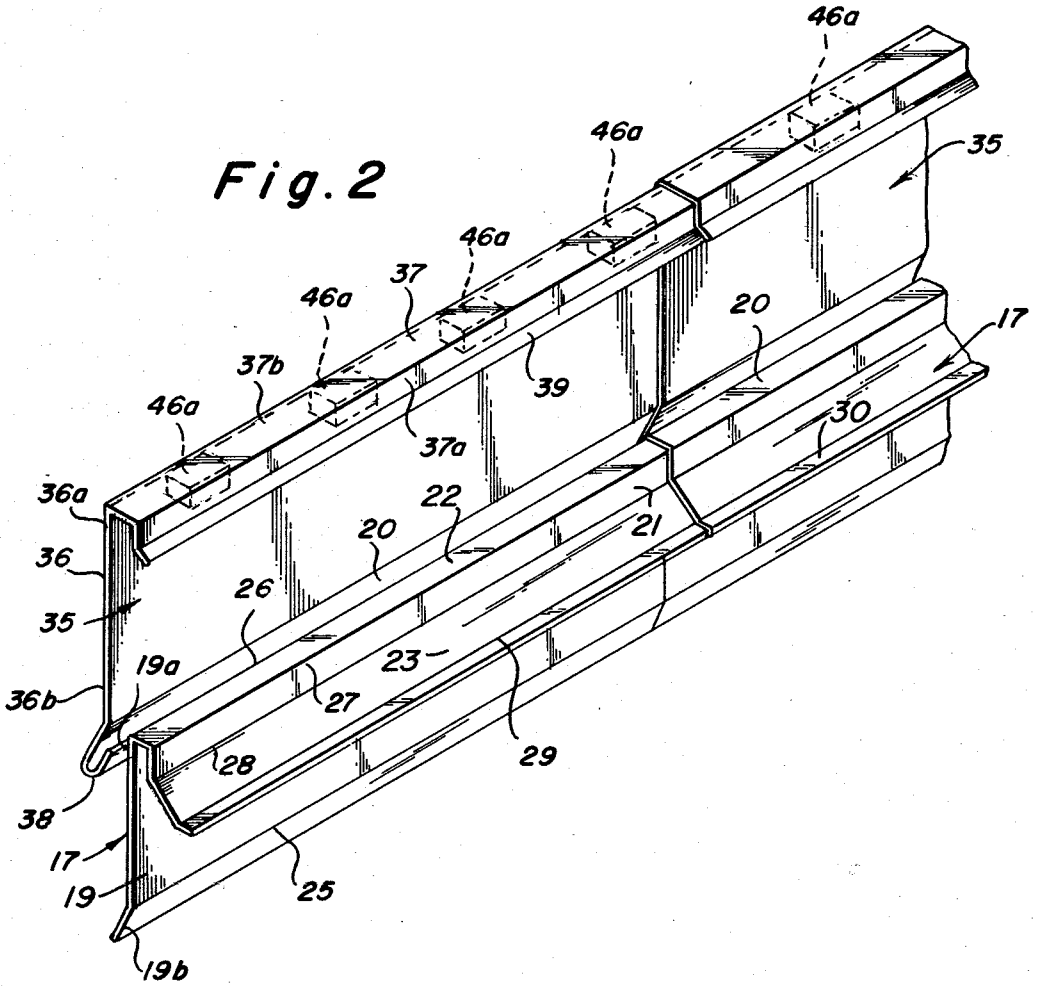
FIG. 2 is an exploded isometric view corresponding to FIG. 1 and representing facia and hood members with biasing means as they all interrelate with dam members.
Figure 5:
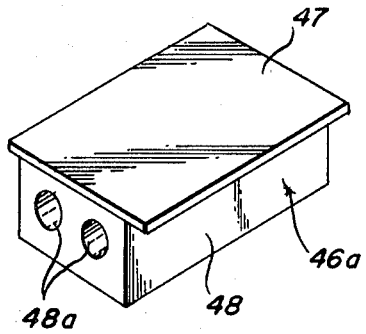
FIG. 5 is an isometric representation of one of the biasing units used in FIGS. 1 and 2.

The dam members 17 in the conjoint facia, hood and water dam 10 are sheathed frontally and over the ridge structures 20 by one or more facia and hood members 35, two such members, similar in transverse cross section, being represented in longitudinal end to end relation in FIG. 2 for covering the dam members 17. Each of the facia and hood members 35 may for example be made of sheet material such as of aluminum base alloy or galvanized steel, whereby components including facia member 36, hood structure 37, and second engagable means to be hereinafter more fully referred to are integral. In certain embodiments in accordance with the present invention, the facia and hood members 35 are produced as extrusions.

More particularly, the facia member 36 for each of the facia and hood members 35 has a substantially downright upper wall portion 36*a* producing in common a substantially downright forward wall of the hood structure 37, and a substantially lower wall portion 36*b* which is integral at lower end with second engagable means comprising longitudinally leading laterally grooved means 38. The grooved means 38 is entrant from the rear of the facia member 36 in a downwardly and forwardly inclined direction and provides a downwardly and forwardly inclined drip flange frontally from the lower end of the facia member 36 in the installed condition of the facia and hood member 35.

The hood structure 37 further includes a substantially downright rearward wall 37*a* laterally opposite the substantially downright forward wall 36*b* of the hood structure 37 and these walls are interconnected in the facia and hood member 35 by a top side 37*b* serving as a bight member in the hood structure 37. A lowermost rearward portion 39 of the facia and hood member 35 is integral with the lower end of the substantially downright rearward wall 37*a* and provides a longitudinal lateral drip flange. Accordingly, in the facia and hood member 35, the grooved means 38 and the facia member 36 are bordered at a lower arris 40 which is substantially parallel with upper arrises 41 and 42 bordering the hood structure top side 37*b* at respectively the substantially downright forward and rearward walls 36*a* and 37*a* of the hood structure 37, and the lower arris 40 also is substantially parallel with an arris 43 bordering the rearward wall 37*a* and the lowermost rearward portion 39. The outer extremity of the lowermost rearward portion 39, and the bight portion of the grooved means 38, in the facia and hood member 35, likewise lead substantially parallel with the arrises 40, 41, 42 and 43.

Adjacent longitudinal ends of the facia and hood members 35 are spliced from inside through use of a splice component 44 (see FIG. 4) which is made of sheet material, such as galvanized steel or aluminum base alloy sheet. The splice component 44 laps against the adjacent facia laterally from inside and to close a gap between the adjacent ends of the facia and hood members 35, thereby allowing for contraction and expansion of the facia and hood members 35. The splice member 44 preferably is introduced as an attachment to a second facia and hood member 35 about to be installed at the end of an already installed first facia and hood member 35, and the splice member 44 accordingly is inserted under the end of the first facia and hood member 35 and is constructed to tolerate, thereafter, downward and then upward installing movements of the second facia and hood member 35.

According to the present embodiment, a plurality of discrete biasing units 46*a* are spaced apart from one another longitudinally of the hood structure 37 of the facia and hood member 35—see FIG. 2. The biasing units 46*a* preferably are pre-assembled with the facia and hood member 35 thus to be carried in the pre-assembly into contact with the already placed sheet roofing 15 on the related ridge structure or structures 20 and for the biasing units 46*a* thereafter to be pressed downwardly in resilient contact with the sheet roofing 15 interposed against the ridge structure 20. The biasing units 46*a* are adequate in number and spacing from one another to carry the facia and hood member 35 bodily resiliently, having the biasing units 46*a* contacting the sheet roofing 15 on the ridge structure 20 of the dam means, and to achieve clamping and biasing in a manner hereinafter to be described.

Each resilient biasing unit 46*a* (see FIGS. 1 and 5) includes a base 47 connected with a soft resilient elastomeric member 48. In order to sustain the biasing unit 46*a* in place, the base 47 is engaged, as for example by cementing, with the facia and hood member 35 inside the hood structure 37 to abut the biasing unit 46*a* against the bight wall 37*b* of the hood structure 37 (see FIG. 1) and in the present instance the resilient elastomeric member 48 has a pair of hollows 48*a* (see FIG. 5) longitudinally therethrough to accomodate compression, and is set off by the base 47 from the inner faces of the substantially downright laterally opposite walls 36*a* and 37*a* of the hood structure 37 to allow for compression of the elastomeric member 48 while the facia and hood member 35 is being installed.

To install a facia and hood member 35, which has been pre-assembled with the biasing units 46*a* as hereinbefore described, the facia and hood member is carried to present the substantially downright laterally opposite walls 36*a* and 37*a* of the hood structure 37 laterally outside the substantially upright sides 19*a* and 21 of the ridge structure 20 of the related one or more of the dam members 17, having the sheet roofing 15 interposed, and to bring the elastomeric members 48 of the biasing units 46*a* into contact with the sheet roofing 15 on the top lateral end 22 of the ridge structure or structures 20. The facia and hood member 35 thereafter is downwardly moved bodily by externally applied force, thereby compressing the elastomeric members 48 of the biasing units 46*a* resiliently and clampingly against the sheet roofing 15 on the top lateral end 22 of the dam member or members 17. Meanwhile, the elastomeric members 48 of the biasing units 46*a* have their bases 47 abutted against the bight wall 37*b* of the hood structure 37.

The lowermost rearward portion 39 of the facia and hood member 35, during the aformentioned downward movement of the facia and hood member 35, defines a narrowing gap within limits with the sheet roofing 15 on the lower inclined rearward side 23 of the related one or more of the dam members 17, enabling the grooved means 38 to be aligned for being engaged with the related tongue means 19*b*, and the biasing means 46 resiliently tolerates being pressed during the downward movement bodily of the facia and hood member 35 to an extent enabling the grooved means 38 to be brought into alignment for being engaged with the related tongue means 19*b*. Upward movement of the facia and hood member 35 bodily thereafter ensues under reactive bias of the resilient biasing units 46*a* with the tongue means 19*b* and the grooved means 38 being engaged and remaining engaged until the upward movement is stopped by the detaining end of the tongue means 19*b* against the bight portion of the grooved means 38. The upward movement of the facia and hood member 35, as urged to occur by reactive thrust from the biasing units 46*a*, is accompanied by a widening of the gap between the lowermost rearward portion 39 of the facia and hood member 35 and the sheet roofing 15 on the lower inclined rearward side 23 of the related one or more of the dam members 17, and after the upward movement has been stopped, in the manner hereinbefore described, the biasing units 46*a* continue to bias the facia and hood member 35 in an upward direction having the lowermost rearward portion 39 remain upwardly away from the sheet roofing 15 on the lower inclined rearward side structure 23 of the dam means.

It will further be appreciated that the substantially downright laterally opposite walls 36*a* and 37*a* of the hood structure 37 remain laterally outside the substantially upright sides 19*a* and 21 of the ridge structure 20 during and after installing the facia and hood member 35, and that the biasing units 46*a* in contact with the sheet roofing 15 clamp the sheet roofing 15 against the top lateral end 22 of the ridge structure 20 during the downward and upward movements of the facia and hood member 35 and after the upward movement of the facia and hood member 35 has been detained. The tongue means 19*b* and the grooved means 38 when engaged interlock laterally of the lead of the tongue means into the grooved means, and the downward and outward inclined lead of the tongue means into the grooved means introduces vertical reach of the tongue means, whereby the facia member 36 is kept from escaping horizontally laterally.

Preferably, the hood structure 37 is horizontally laterally loosely allocated by the substantially downright walls 36*a* and 37*a* being horizontally laterally loosely outside the ridge structure 20 and the sheet roofing 15 thereon, to facilitate the downward and upward movements of the facia and hood member 35 and to alleviate drag of the hood structure against the sheet roofing. Horizontal lateral stability meanwhile is induced to the hood structure 37 by the related compressed biasing units 46*a* during the downward and upward movements of the facia and hood member 35 and in the installed condition of the facia and hood member 35.

In the present embodiment, the sheet roofing 15 leads between the substantially downright walls 36*a* and 37*a* of the hood structure 37 and the substantially upright sides 19*a* and 21 of the ridge structure 20 and the top lateral end 22 of the ridge structure 20; however, in certain embodiments in the practice of this invention the sheet roofing 15 terminates just after passing between the top lateral end 22 and the biasing means 46, though the latter practice is not preferred.

A further feature involves having the grooved means 38 and the tongue means 19*b* relatively movable to snap into alignment for thereafter being engaged. For this snap action to occur, the hood structure 37 is allocated to be within horizontal lateral units initially by the substantially downright walls 36*a* and 37*a* thereof being laterally outside the ridge structure 20 of the related dam member or members 17 and the sheet roofing 15 thereon, for thereafter enabling the hood structure 37, as stabilized horizontally laterally by the compressed biasing means 46 during the downward movement of the facia and hood member 35, to constrain the facia 36 to press the grooved means 38 and the tongue means 19*b* together slidably one off the other and to snap one off the other into alignment for being engaged, and then have the upward movement of the facia and hood member 35 ensue under bias of the biasing means 46 with the grooved means 38 and the tongue means 19*b* engaged.

Figure 6:
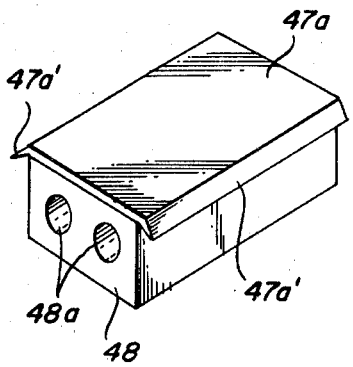
FIG. 6 represents in isometric view a modified form of biasing unit.
Figure 7:
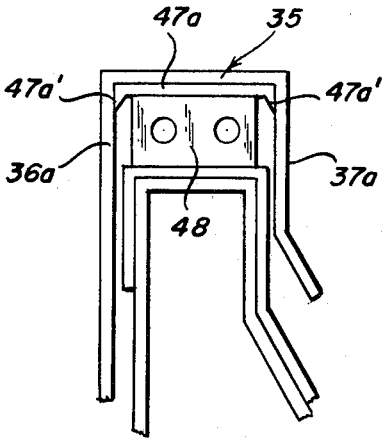
FIG. 7 is an end elevation with the biasing unit of FIG. 6 installed.
Figure 8:
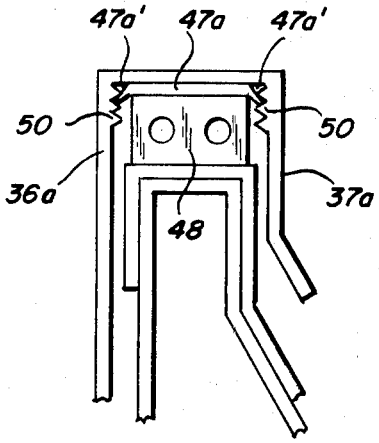
FIG. 8 is an end elevation representing a facia and hood member with modified hood structure interrelated with the biasing unit of FIG. 6.

In certain embodiments in accordance with this invention, biasing units otherwise similar to the biasing units 46*a* hereinbefore described are characterized by having a firmly resilient base member 47*a* with lateral wedge ends 47*a*′ (see FIGS. 6 and 7) so that the lateral wedge ends 47*a*′ frictionally engage the biasing unit with the substantially downright walls 36*a* and 37*a* of the hood structure 37 by press fit or, according to FIG. 8, by snap fit behind longitudinal serrations or rib means 50 provided on the inner faces of the substantially downright walls 36*a* and 37*a* of the hood structure.

In a further embodiment herein (see FIGS. 9 and 10) each of discrete biasing units 46*a*′ has a base plate 51 from which resilient arm means 52 is struck to project downwardly resiliently from the base plate 51 into contact with sheet roofing 15 on the ridge structure 20 of the dam means. The base plate 51 of the resilient biasing unit 46*a*′ has downwardly and outwardly directed tabs 53 along the opposite lateral edges thereof for biting into the inner faces of the side walls 36*a* and 37*a* of the related hood structure 37 of a facia and hood member 35 to maintain the biasing unit 46*a*′ in position after the biasing unit 46*a*′ has been pre-assembled with the facia and hood member 35.

In a still further embodiment in accordance with the present invention (see FIG. 11), the biasing means used between the facia and hood member 35 and the ridge structure 20 of the dam means includes a plurality of biasing members 56 spaced from one another longitudinally of the facia and hood member 35, inside the hood structure 37, and secured to interconnecting strip means 57 to project laterally from the strip means 57, the latter forming a backing to abut the biasing members 56 against the top end 22 of the hood structure, having the biasing members 56 pressed against the sheet roofing 15 on the ridge structure 20 of the dam means. The present biasing and strip means preferably is pre-assembled with the facia and hood member 35 to be carried with the latter or, alternatively, though not preferably, is put in place having the biasing members 56 against the sheet roofing 15 on the ridge structure 20 of the dam means before bringing the facia and hood member 35 over the dam means.

According to still another embodiment herein (see FIG. 12), the facia and hood member 35 is instead biased, for the purposes hereinbefore described, by substantially continuous resilient strip means 60 made for example of elastomeric open cell foam and having an over-all length inside the hood structure 37 of the facia and hood member 35 sufficient to carry the facia and hood member 35 biased and upheld while the biasing strip means 60 contacts the sheet roofing 15 on the hood structure 37 of the dam means. The biasing strip means 60 and the facia and hood member 35 preferably are pre-assembled to be installed as a unit; however, in other embodiments which are not presently preferred the biasing strip means 60 is placed on the ridge structure 20 of the dam means before installing the facia and hood member 35. In other instances, elastomeric foam strip material similar to that of the strip 60 is reduced to segments and the segments are installed as discrete biasing units spaced apart from one another longitudinally of the hood structure 37 inside the hood structure 37 and are held in place such as by friction or cementing in a pre-assembly with the facia and hood member 35.

As the invention lends itself to many possible embodiments and as many possible changes may be made in the embodiments hereinbefore set forth, it will be distinctly understood that all matter described herein is to be interpreted as illustrative and not as a limitation.

I claim:

1. In a conjoint facia, hood and water dam, the combination which includes; dam and first engagable means comprising, dam means having longitudinal ridge structure which includes upwardly extending laterally opposite forward and rearward sides and top lateral end means, and said dam means adapted to be on a roof deck of a building and installed adjacent to a wall of said building for sustaining said ridge structure in a substantially fixed position above said roof deck and supporting sheet roofing having a rearward lower portion of said sheet roofing lead from said roof deck at the rear of said dam means and an upper portion of said sheet roofing extend over said top lateral end means of said ridge structure to be covered, and first engagable means adapted to be in a position adjacent to said building wall and below said ridge structure; facia and hood means including at least one facia and hood member and said facia and hood member comprising, facia means to be disposed frontally of said dam means and said wall of said building, second engagable means connected with said facia means, and hood structure to cover said ridge structure and said upper portion of said sheet roofing on said top lateral end means of said ridge structure, said hood structure having a downwardly extending forward wall, and a rearward portion lowermost to be spaced stably upwardly free of said lower portion of said sheet roofing, said rearward portion comprising a downwardly extending rearward wall laterally opposite said forward wall, and said first engagable means and said second engagable means together including tongue means and grooved means for said tongue means and said grooved means to be engaged and said first engagable means including detaining means for movement of said facia and hood member in an upward direction relatively to said dam and first engagable means to be stopped, said tongue means to be received leading in a direction which intersects with horizontal into said grooved means during upward movement of said facia and hood member, to engage said tongue means and said grooved means laterally interlockingly and maintain said facia means horizontally laterally restrained; and resilient biasing means; said facia and hood member in being installed being downwardly and then upwardly moved with said downwardly extending laterally opposite forward and rearward walls of said hood structure being laterally outside said upwardly extending laterally opposite forward and rearward sides of said ridge structure, and said resilient biasing means being inside said hood structure and abutting said hood structure while over said upper portion of said sheet roofing on said top lateral end means of said ridge structure and pressed during said downward movement of said facia and hood member, for clamping said sheet roofing against said top lateral end means of said ridge structure and enabling said tongue means and said grooved means to be aligned for being engaged in response to upward movement of said facia and hood member meanwhile having said hood structure cover said upper portion of said sheet roofing, and for said biasing means reactively to bias said facia and hood member to effect said upward movement of said facia and hood member with said tongue means and said grooved means engaged until said facia and hood member is stopped by said detaining means, thereafter having said downwardly extending laterally opposite forward and rearward walls of said hood structure still laterally outside said upwardly extending laterally opposite sides of said ridge structure and said hood structure still covering said upper portion of said sheet roofing, said tongue means and said grooved means still engaged, and said biasing means still clamping said upper portion of said sheet roofing against said top lateral end means of said ridge structure and reactively urging said facia and hood member in an upward direction to maintain said hood structure stable with said rearward portion of said hood structure meanwhile being lowermost stably spaced upwardly free of said lower portion of said sheet roofing.

2. In a conjoint facia, hood and water dam as set forth in claim 1, wherein said facia and hood member and said biasing means are pre-assembled having said biasing means inside said hood structure, for said facia and hood member, in being installed, to carry said biasing means into being over said sheet roofing on said top lateral end means of said ridge structure and abutted against said hood structure to press downwardly.

3. In a conjoint facia, hood and water dam as set forth in claim 1, wherein said biasing means includes a plurality of discrete biasing units pre-assembled securely with said facia and hood member having said biasing units spaced apart from one another longitudinally of said hood structure inside said hood structure, for said facia and hood member, in being installed, to carry said discrete biasing units into being pressed against said sheet roofing on said top lateral end means of said ridge structure, and for said biasing units pressed against said sheet roofing on said top lateral end means of said ridge structure and abutting against said hood structure to bias said facia and hood member bodily in an upward direction during said downward and upward movements of said facia and hood member and after said upward movement of said facia and hood member has been stopped by said detaining means.

4. In a conjoint facia, hood and water dam as set forth in claim 3, wherein at least one of said discrete biasing units includes base plate means engaged with said facia and hood member inside said hood structure, and resilient arm means struck from said base plate means, for said resilient arm means to press downwardly against said sheet roofing on said top lateral end means of said ridge structure having said base plate abutted against said hood structure.

5. In a conjoint facia, hood and water dam as set forth in claim 3, wherein at least one of said biasing units includes base means engaged with said facia and hood member inside said hood structure, and resilient elastomeric biasing means set off from inner faces of said downwardly extending laterally opposite walls of said hood structure by said base means and extending from said base means to press downwardly against said sheet roofing on said top lateral end means of said ridge structure having said base means abutted against said hood structure.

6. In a conjoint facia, hood and water dam as set forth in claim 1, wherein said biasing means includes resilient strip means substantially continuously extending longitudinally with said hood structure of said facia and hood member inside said hood structure a distance for said resilient strip means pressed downwardly against said sheet roofing of said top lateral end means of said ridge structure, and abutted against said hood structure, to reactively bias said facia and hood member bodily in an upward direction.

7. In a conjoint facia, hood and water dam as set forth in claim 6, wherein said facia and hood member and said resilient strip means are pre-assembled having said resilient strip means securely inside said hood structure, for said facia and hood member, in being installed, to carry said resilient strip means into being pressed against said sheet roofing on said top lateral end means of said ridge structure.

8. In a conjoint facia, hood and water dam as set forth in claim 1, wherein said biasing means includes biasing and interconnecting means comprising a plurality of biasing members spaced from one another, and means interconnecting said spaced biasing members having said biasing members project laterally of said interconnecting means, for said laterally projecting interconnected biasing members pressed downwardly against said sheet roofing on said top lateral end means of said ridge structure and abutted against said hood structure, inside said hood structure, to reactively bias said facia and hood member bodily in an upward direction.

9. In a conjoint facia, hood and water dam as set forth in claim 8, wherein said facia and hood member and said biasing and interconnecting means are pre-assembled having said biasing and interconnecting means securely inside said hood structure, for said facia and hood member, in being installed, to carry said spaced biasing members into being pressed against said sheet roofing on said top lateral end means of said ridge structure.

10. In a conjoint facia, hood and water dam as set forth in claim 1, wherein said hood structure is allocated horizontally laterally relatively to said ridge structure by said downwardly extending laterally opposite walls of said hood structure being horizontally laterally outside said ridge structure and said sheet roofing thereon and is stabilized by said pressed biasing means during said downward movement of said facia and hood member, to constrain said facia means to press said grooved means and said tongue means laterally together slidably one against the other and to snap one off the other into alignment for being engaged; and said grooved means and said tongue means thereafter are engaged as a result of said upward movement of said facia and hood member.

11. In a conjoint facia, hood and water dam as set forth in claim 10, wherein said hood structure of said facia and hood member is loosely allocated horizontally laterally relatively to said ridge structure by said downwardly extending laterally opposite walls of said hood structure being horizontally laterally outside said ridge structure and said sheet roofing thereon, and said hood structure is horizontally laterally stabilized by said pressed biasing means during said downward and upward movements of said facia and hood member and after said upward movement of said facia and hood member has been stopped by said detaining means.

12. In a conjoint facia, hood and water dam, the combination which includes; dam and first engagable means comprising, dam means including, longitudinal ridge structure having upwardly extending laterally opposite forward and rearward sides and top lateral end means, and a lower rearward inclined side of said dam means to deviate downwardly and rearwardly from a lower end of said upwardly extending rearward side of said ridge structure toward a roof deck of a building, and said dam means adapted to be on said roof deck and installed adjacent to a wall of said building for sustaining said ridge structure in a substantially fixed position above said roof deck and for supporting sheet roofing having the latter lead from said roof deck at the rear of said dam means onto said lower rearward inclined side of said dam means and onto said top lateral end means of said ridge structure, and first engagable means adapted to be in a position adjacent to said building wall and below said ridge structure; facia and hood means comprising at least one facia and hood member and said facia and hood member including facia means to be disposed frontally of said dam means and said wall of said building, second engagable means connected with said facia means, and hood structure to cover said sheet roofing on said top lateral end means of said ridge structure, said hood structure having a downwardly extending forward wall and a rearward portion lowermost to be spaced upwardly free of said sheet roofing on said lower inclined rearward side of said dam means, said rearward portion of said hood structure comprising a downwardly extending rearward wall laterally opposite said forward wall, and said first engagable means and said second engagable means together comprising tongue means and grooved means for said tongue means and said grooved means to be engaged and said first engagable means comprising detaining means for movement of said facia and hood member in an upward direction relatively to said dam and first engagable means to be stopped, said tongue means to be received leading in a direction which intersects with horizontal into said grooved means during upward movement of said facia and hood member, to engage said tongue means and said grooved means laterally interlockingly and maintain said facia means horizontally laterally restrained; and resilient biasing means; said facia and hood member in being installed being downwardly and then upwardly moved with said downwardly extending forward and rearward walls of said hood structure being laterally outside said upwardly extending laterally opposite forward and rearward sides of said ridge structure and with said sheet roofing being disposed on said top lateral end means of said ridge structure and on said lower rearward inclined side of said dam means, said rearward portion of said hood structure defining a narrowing gap within limits with said sheet roofing on said lower inclined rearward side of said dam means during said downward movement of said facia and hood member, while having said biasing means inside said hood structure abutting said hood structure and pressed downwardly clampingly against said sheet roofing on said top lateral end means of said ridge structure, enabling said tongue means and said grooved means to be aligned for being engaged in response to upward movement of said facia and hood member and said biasing means reactively to bias said facia and hood member to affect said upward movement continuing with said tongue means and said grooved means engaged and with said gap between said rearward portion of said hood structure and said sheet roofing on said lower rearward inclined side of said dam means widening until said facia and hood member is stopped by said detaining means, thereafter having said downwardly extending laterally opposite walls of said hood structure still laterally outside said upwardly extending laterally opposite sides of said ridge structure and said hood structure still covering said sheet roofing on said top lateral end means of said ridge structure, said tongue means and said grooved means still engaged and said biasing means still clamping said sheet roofing against said top lateral end means of said ridge structure and reactively urging said facia and hood member in an upward direction to maintain said hood structure stabilized with said rearward portion of said hood structure meanwhile lowermost being stably spaced upwardly free of said sheet roofing on said lower inclined rearward side of said dam means.

13. In a conjoint facia, hood and water dam as set forth in claim 12, wherein said hood structure is allocated horizontally laterally relatively to said ridge structure by said downwardly extending laterally opposite walls of said hood structure being horizontally laterally outside said ridge structure and said sheet roofing thereon and is horizontally laterally stabilized by said pressed biasing means during said downward movement of said facia and hood member to constrain said facia means to press said grooved means and said tongue means laterally together slidably one against the other and to snap one off the other into alignment for being engaged, and said grooved means and said tongue means thereafter are engaged as a result of said upward movement of said facia and hood member.

14. In a conjoint facia, hood and water dam as set forth in claim 13, wherein said facia and hood member and said biasing means are pre-assembled securely having said biasing means inside said hood structure, for said facia and hood member, in being installed, to carry said biasing means into being pressed against said sheet roofing on said top lateral end means of said ridge structure and said biasing means to abut against said hood structure in being pressed downwardly.

15. In a conjoint facia, hood and water dam as set forth in claim 14, wherein said biasing means includes a plurality of discrete resilient biasing units spaced apart from one another inside said hood structure and securely pre-assembled with said facia and hood member.

16. In a conjoint facia, hood and water dam as set forth in claim 14, wherein said biasing means includes elastomeric strip means substantially continuously extending longitudinally with said hood structure of said facia and hood member inside said hood structure a distance for said elastomeric strip means to be pressed downwardly against said sheet roofing on said top lateral end means of said ridge structure, and abutted against said hood structure, to reactively bias said facia and hood member bodily in an upward direction.

* * * * *